US008824916B2

(12) United States Patent
Hirai et al.

(10) Patent No.: US 8,824,916 B2
(45) Date of Patent: Sep. 2, 2014

(54) BELT CONVEYOR MEMBER AND IMAGE FORMING APPARATUS

(71) Applicants: Masashi Hirai, Osaka (JP); Toshiki Takiguchi, Osaka (JP)

(72) Inventors: Masashi Hirai, Osaka (JP); Toshiki Takiguchi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 13/644,350

(22) Filed: Oct. 4, 2012

(65) Prior Publication Data

US 2013/0084097 A1 Apr. 4, 2013

(30) Foreign Application Priority Data

Oct. 4, 2011 (JP) ..... 2011-220244

(51) Int. Cl.
*G03G 21/10* (2006.01)
*G03G 15/16* (2006.01)

(52) U.S. Cl.
USPC ..... 399/101; 399/123

(58) Field of Classification Search
USPC ..... 399/123
See application file for complete search history.

(56) References Cited

U.S. PATENT DOCUMENTS

| | | | | |
|---|---|---|---|---|
| 6,253,044 | B1 | 6/2001 | Shoji et al. | |
| 6,711,368 | B2 * | 3/2004 | Ogasawara | 399/159 |
| 7,610,008 | B2 * | 10/2009 | Watanabe et al. | 399/350 |
| 7,778,585 | B2 * | 8/2010 | Uchida et al. | 399/350 |

FOREIGN PATENT DOCUMENTS

| | | | | |
|---|---|---|---|---|
| JP | 2000-284661 | A | | 10/2000 |
| JP | 2003-149964 | A | | 5/2003 |
| JP | 2004-101556 | A | | 4/2004 |
| JP | 2004101556 | A | * | 4/2004 |
| JP | 2005-82327 | A | | 3/2005 |
| JP | 2007-017666 | A | | 1/2007 |
| JP | 2010-250355 | A | | 11/2010 |
| JP | 2012-18250 | A | | 1/2012 |
| JP | 2012018250 | A | * | 1/2012 |

* cited by examiner

*Primary Examiner* — Clayton E Laballe
*Assistant Examiner* — Leon W Rhodes, Jr.
(74) *Attorney, Agent, or Firm* — Birch, Stewart, Kolasch & Birch, LLP

(57) ABSTRACT

A belt conveyor member includes an endless belt and a cleaning blade. The cleaning blade is configured to remove residual toner remaining on a surface of the endless belt which is processed into a smooth surface. The endless belt has a first region and a second region. The first region is a region in contact with the cleaning blade which is located outside a region for a recording sheet of a maximum usable width to pass therethrough. The second region is located outside the first region. A contact surface between the cleaning blade and the first region is in a rough condition free from intimate contact.

5 Claims, 5 Drawing Sheets

BELT CONVEYOR MEMBER AND IMAGE FORMING APPARATUS

CROSS REFERENCE

This Nonprovisional application claims priority under 35 U.S.C. §119(a) on Patent Application No. 2011-220244 filed in Japan on Oct. 4, 2011, the entire contents of which are hereby incorporated by reference.

BACKGROUND OF THE INVENTION

The present invention relates to a belt conveyor member having a widthwise central portion and a widthwise end portion which are provided with different contact surfaces in contact with a cleaning blade.

A full-color image forming apparatus using an intermediate transfer system is configured to obtain a color image by provisionally transferring a plurality of toner images that are formed on respective image bearing members on a color-by-color basis onto an intermediate transfer belt in such a manner that the toner images are superimposed on one another and then collectively transferring the toner images onto a recording medium such as a paper sheet. The transfer from the image bearing members to the intermediate transfer belt is called the "primary transfer", while the transfer from the intermediate transfer belt to the recording medium is called the "secondary transfer".

In the secondary transfer process, in particular, a secondary transfer roller is pressed against the intermediate transfer belt bearing the toner images across the recording medium, while a bias is applied to the secondary transfer roller and the like to generate an electric field. By so doing, the toner images are secondarily transferred onto the recording medium.

In attempt to improve the image quality resulting from such a secondary transfer process, a proposal has been made of provision of one or more hard layers on a surface of the intermediate transfer belt (see Japanese Patent Laid-Open Publication No. 2007-017666 for example).

The technique disclosed in Japanese Patent Laid-Open Publication No. 2007-017666, however, raises a problem with the relationship between the endless belt and the cleaning blade. Specifically, in cases where the roughness of the belt surface fails to increase and hence remains low because of a failure to supply toner serving as a lubricant to the surface of the intermediate transfer belt, the degree of intimate contact between the endless belt surface and the cleaning blade increases to cause the load imposed on an edge portion of the cleaning blade to increase, thus raising problems including a deformation of the cleaning blade, a cleaning failure due to distortion of the cleaning blade, a degradation in image quality due to banding, and reversal of the cleaning blade.

With the foregoing problems in view, a feature of the present invention is to provide a belt conveyor member which is capable of avoiding an increase in the degree of intimate contact between the endless belt and the cleaning blade.

SUMMARY OF THE INVENTION

A belt conveyor member according to the present invention includes an endless belt and a cleaning blade. The cleaning blade is configured to remove residual toner remaining on a surface of the endless belt which is processed into a smooth surface. The endless belt has a first region and a second region. The first region is a region in contact with the cleaning blade which is located outside a region for a recording sheet of a maximum usable width to pass therethrough. The second region is a region which is located outside the first region. A contact surface between the first region and the cleaning blade is in a rough condition free from intimate contact.

With this arrangement, the contact surface between the cleaning blade and the first region which is used with a low frequency in usual image formation and hence is less likely to be supplied with toner serving as a lubricant is in a rough condition free from intimate contact, thus avoiding an increase in the degree of intimate contact between the endless belt and the cleaning blade.

Therefore, the arrangement according to the present invention can prevent the occurrence of inconveniences including an increase in the load imposed on an edge portion of a widthwise end portion of the cleaning blade, a deformation of the cleaning blade, a cleaning failure due to distortion of the cleaning blade, and a degradation in image quality due to banding, and reversal of the cleaning blade.

A widthwise central portion of the endless belt which is used with a high frequency in usual image formation and hence is appropriately supplied with toner serving as a lubricant is processed into a smooth surface. Therefore, when a process control patch is formed on the central portion, reflected light for density detection can be prevented from scattering, thereby ensuring a highly precise correction.

DETAILED DESCRIPTION OF THE INVENTION

Hereinafter, embodiments of a belt conveyor member according to the present invention will be described in detail with reference to the attached drawings.

Initially, description is directed to a first embodiment.

Figure 1:
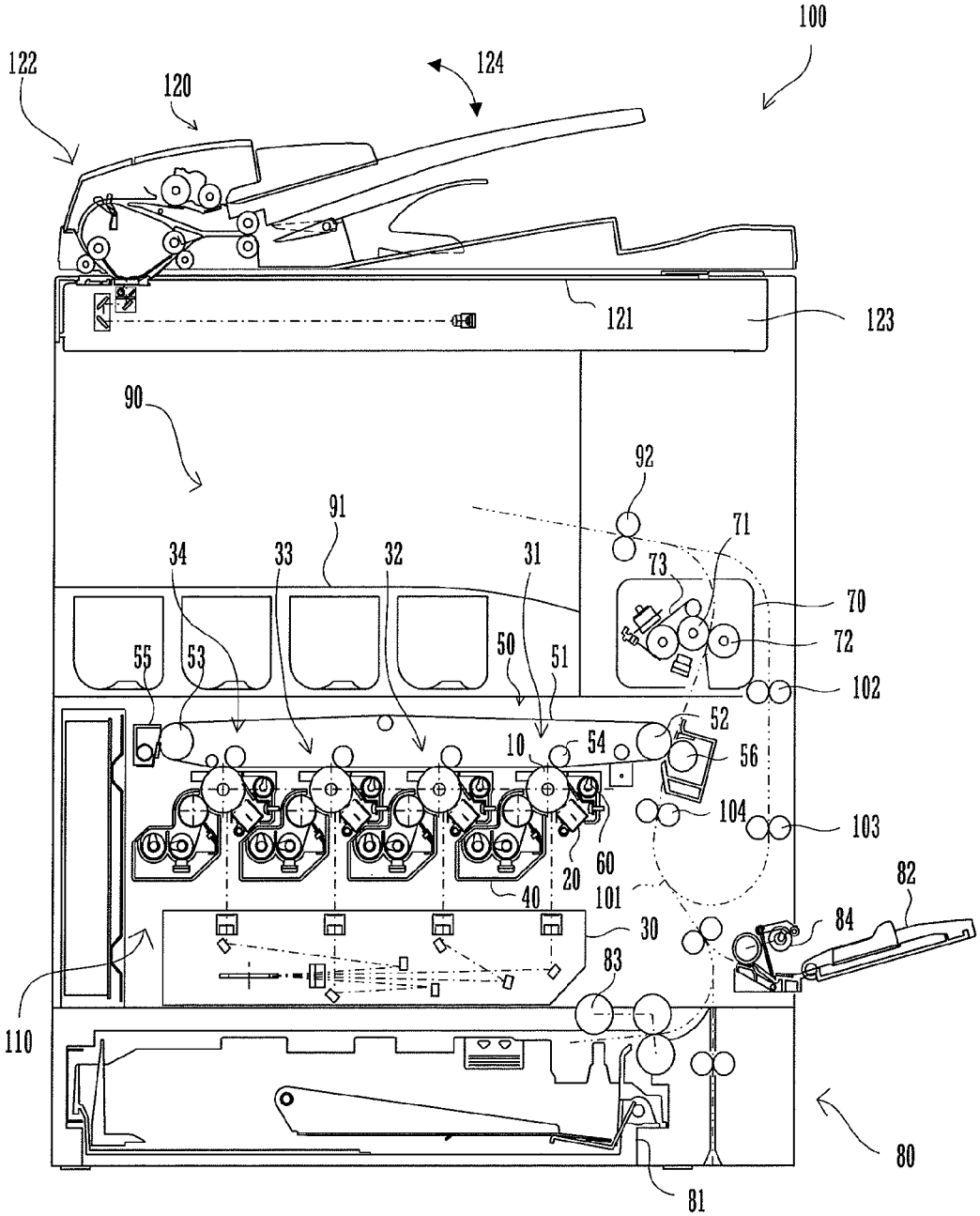
FIG. 1 is a front elevational view illustrating a configuration of an image forming apparatus according to a first embodiment of the present invention.

FIG. 1 is a front elevational view illustrating a configuration of an image forming apparatus 100 according to a first embodiment of the present invention.

The image forming apparatus 100 is configured to form a polychrome or monochrome image on a predetermined sheet (i.e., recording sheet) according to image data transmitted thereto from the outside. The image forming apparatus 100 comprises a document processing device 120, a sheet feeding portion 80, an image forming portion 110, and a sheet output portion 90.

The document processing device 120 includes a document platen 121, a document feeder 122, and a document reading portion 123. The document platen 121 is capable of placing a document thereon. The document feeder 122 feeds documents one by one from a document tray loaded with the documents. The document feeder 122 is pivotable in directions indicated by arrow 124. When the document feeder 122 pivots in a direction such as to expose the document platen 121, a document can be placed on the document platen 121. The document reading portion 123 reads a document being fed by the document feeder 122 or a document placed on the document platen 121.

The sheet feeding portion 80 includes a sheet feed cassette 81, a manual feed cassette 82, and pickup rollers 83 and 84. The sheet feed cassette 81 is a tray for stacking standard size sheets thereon. The manual feed cassette 82 is a tray capable of placing non-standard size sheets thereon. The pickup roller 83, which is located adjacent an end portion of the sheet feed cassette 81, picks up sheets one by one from the sheet feed cassette 81 to feed each sheet into a sheet feed path 101. Likewise, the pickup roller 84, which is located adjacent an end portion of the manual feed cassette 82, picks up sheets one by one from the manual feed cassette 82 to feed each sheet into the sheet feed path 101.

The image forming portion 110 includes image forming stations 31 to 34, an exposure unit 30, an intermediate transfer belt unit 50, and a fixing unit 70. The image forming stations 31 to 34 are each provided with a photoreceptor drum 10, an electrostatic charger device 20, a developing device 40, and a cleaner unit 60. The image forming stations 31 to 34 are configured to form respective color images by using respective colors, i.e., black (K), cyan (C), magenta (M) and yellow (Y). In the present embodiment, description is directed to the image forming station 31.

The photoreceptor drum 10 is configured to bear a developer image thereon by rotation during image formation. Around the photoreceptor drum 10, there are disposed the electrostatic charger device 20, exposure unit 30, developing device 40, intermediate transfer belt unit 50 and cleaner unit 60 in the order described from an upstream side in the direction of rotation of the photoreceptor drum 10. The fixing unit 70 is disposed on the sheet feed path 101 at a location most downstream in the image forming portion 110.

The electrostatic charger device 20 is means for electrostatically charging a peripheral surface of the photoreceptor drum 10 to a predetermined potential uniformly. The exposure unit 30 has the function of exposing the photoreceptor drum 10 in an electrostatically charged state to light according to image data inputted, thereby forming an electrostatic latent image according to the image data on the peripheral surface of the photoreceptor drum 10. The developing device 40 is configured to visualize the electrostatic latent image formed on the photoreceptor drum 10 by using toner.

The intermediate transfer belt unit 50 includes an intermediate transfer belt 51, an intermediate transfer belt driving roller 52, an intermediate transfer belt idle roller 53, an intermediate transfer roller 54, and an intermediate transfer belt cleaning unit 55.

The intermediate transfer belt driving roller 52, intermediate transfer belt idle roller 53 and intermediate transfer roller 54, about which the intermediate transfer belt 51 is entrained, drive the intermediate transfer belt 51 for rotation. The intermediate transfer roller 54 performs application of a transfer bias for transferring the toner image from the photoreceptor drum 10 onto the intermediate transfer belt 51.

The intermediate transfer belt 51 is positioned to come into contact with the photoreceptor drum 10. The intermediate transfer belt 51 has the function of forming the toner image thereon by transfer of the toner image from the photoreceptor drum 10 onto the intermediate transfer belt 51.

The transfer of the toner image from the photoreceptor drum 10 to the intermediate transfer belt 51 is achieved by the intermediate transfer roller 54 in contact with the reverse side of the intermediate transfer belt 51. The intermediate transfer roller 54 is applied with a high transfer bias voltage (i.e., a high voltage having a polarity (+) opposite to the polarity (−) of the toner charged) in order to transfer the toner image.

At that time, the intermediate transfer belt 51 and the transfer roller 56 are pressed against each other at a predetermined nip pressure, while the transfer roller 56 is applied with a voltage for transferring the toner to the recording sheet (i.e., a high voltage having a polarity (+) opposite to the polarity (−) of the toner charged).

Toner thus attached to the intermediate transfer belt 51 by contact between the photoreceptor drum 10 and the intermediate transfer belt 51 or residual toner remaining on the intermediate transfer belt 51 without having been transferred onto the recording sheet by the transfer roller 56, is removed and recovered by the intermediate transfer belt cleaning unit 55. The intermediate transfer belt cleaning unit 55 includes, for example, a cleaning blade 210 as a cleaning member in contact with the intermediate transfer belt 51. The intermediate transfer belt 51 contacted by the cleaning blade 210 is supported by the intermediate transfer belt idle roller 53 from the reverse side thereof.

The cleaner unit 60 removes and recovers residual toner that remains on the peripheral surface of the photoreceptor drum 10 after the image transfer operation following the developing operation.

The fixing unit 70 includes a heating roller 71 and a pressurizing roller 72 which are configured to rotate while nipping a sheet therebetween. An external heating belt 73 is provided for heating the heating roller 71 from the outside.

The sheet output portion 90 has a sheet output tray 91 and sheet output rollers 92. Each recording sheet having passed through the fixing unit 70 is outputted onto the sheet output tray 91 by passing between the sheet output rollers 92. The sheet output tray 91 is a tray for accumulating sheets finished with printing.

In cases where double-side printing is requested, when a sheet having been finished with one-side printing as described above and passed through the fixing unit 70 is held between the sheet output rollers 92 at its trailing edge, the sheet output rollers 92 rotate backwardly to feed the sheet to feed rollers 102 and then to feed rollers 103. Thereafter, the sheet is subjected to reverse-side printing after having passed between registration rollers 104 and is then outputted onto the sheet output tray 91.

Figure 2:
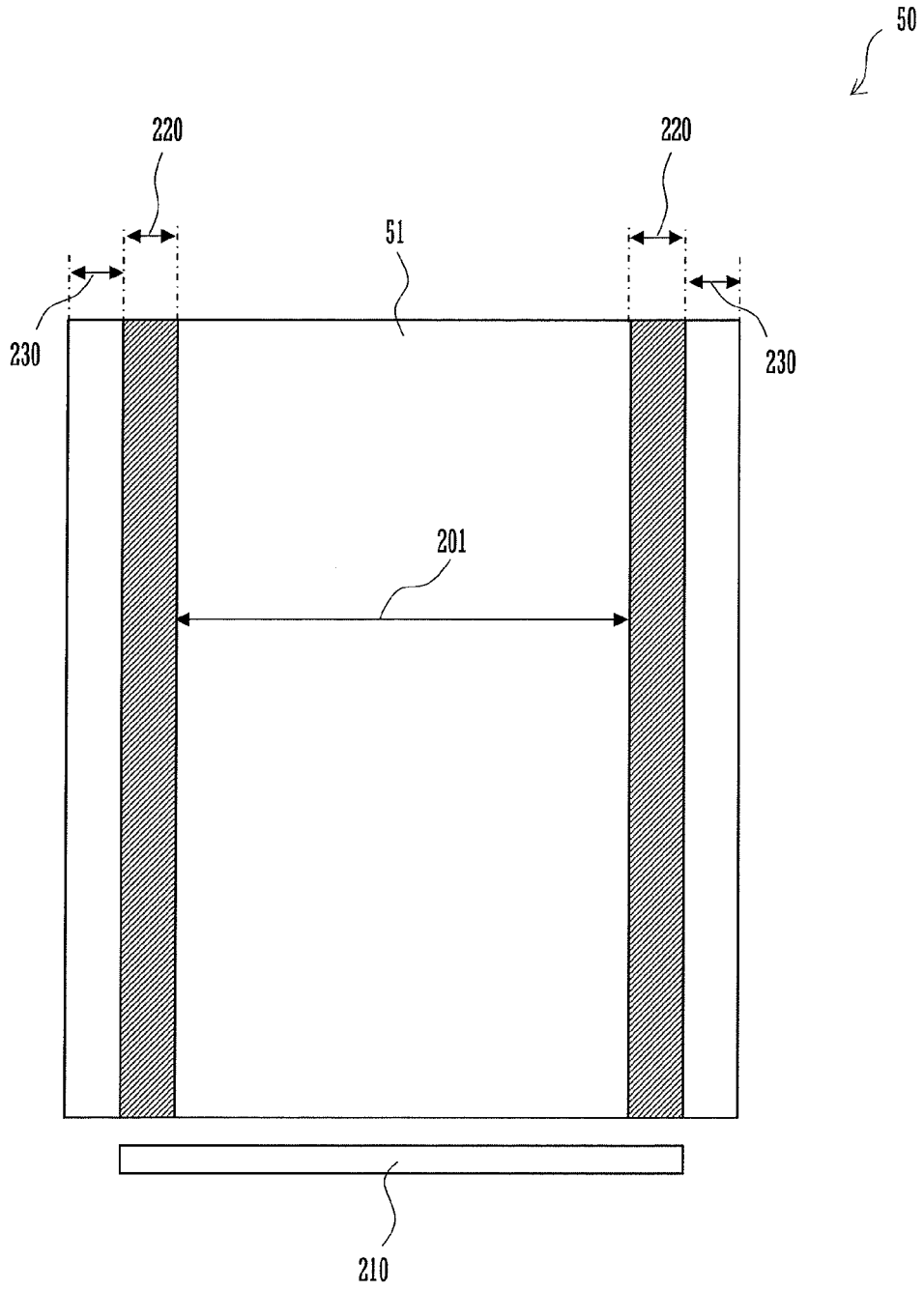
FIG. 2 is a plan view illustrating an arrangement of an intermediate transfer belt unit according to the first embodiment of the present invention.

FIG. 2 is a plan view illustrating an arrangement of the intermediate transfer belt unit 50 according to the first embodiment of the present invention.

The intermediate transfer belt unit 50 is a belt conveyor member including the intermediate transfer belt 51 and the cleaning blade 210. The cleaning blade 210 is in contact with a region of the intermediate transfer belt 51 for a recording sheet of a maximum usable width to pass therethrough. The maximum usable width is A4 vertical size for example. In the present embodiment, the A4 vertical size is determined as a maximum usable width 201. The intermediate transfer belt 51 contacted by the cleaning blade 210 is supported by the intermediate transfer belt idle roller 53 from the reverse side thereof. It is to be noted that the concept of the "belt conveyor member" includes not only the intermediate transfer belt unit 50 but also a transfer conveyor belt.

The intermediate transfer belt 51 is an endless belt. The cleaning blade 210 removes residual toner remaining on a surface of the intermediate transfer belt 51 which is processed into a smooth surface. The region of the intermediate transfer belt 51 which is processed to have a smooth surface is the region for a recording sheet of the maximum usable width 201 to pass therethrough.

The intermediate transfer belt 51 includes a first region 220 and a second region 230. The first region 220 is a region which is located outside the region for a recording of the maximum usable width 201 to pass therethrough and which is in contact with the cleaning blade 210. The second region 230 is a region which is located outside the first region 220.

A contact surface between the cleaning blade 210 and the first region 220 is in a rough condition free from intimate contact. The condition of the contact surface will be described with reference to FIG. 2 and the succeeding FIGURES.

With this arrangement, the contact surface between the cleaning blade 210 and the first region 220 which is used with a low frequency in usual image formation and hence is less likely to be supplied with toner serving as a lubricant, is in a rough condition free from intimate contact, thus avoiding an increase in the degree of intimate contact between the intermediate transfer belt 51 and the cleaning blade 210.

Therefore, the arrangement according to the present embodiment can prevent the occurrence of inconveniences including an increase in the load imposed on an edge portion of a widthwise end portion of the cleaning blade 210, a deformation of the cleaning blade 210, a cleaning failure due to distortion of the cleaning blade 210, a degradation in image quality due to banding, and reversal of the cleaning blade 210.

A widthwise central portion of the intermediate transfer belt 51 (i.e., the region for a recording sheet of the maximum usable width to pass therethrough) which is used with a high frequency in usual image formation and hence is appropriately supplied with toner serving as a lubricant, has a surface processed into a smooth surface. Therefore, when a process control patch is formed on the central portion, reflected light for density detection can be prevented from scattering, thereby ensuring a highly precise correction.

In FIG. 2, the surface of the first region 220 is made rougher than that of the widthwise central portion of the intermediate transfer belt 51.

With this arrangement in which the first region 220 of the intermediate transfer belt 51 is made to have a rough surface, there is no need to process the cleaning blade 210, which makes it easy to manufacture the intermediate transfer belt unit 50.

The next description is directed to a second embodiment of the present invention.

Figure 3:
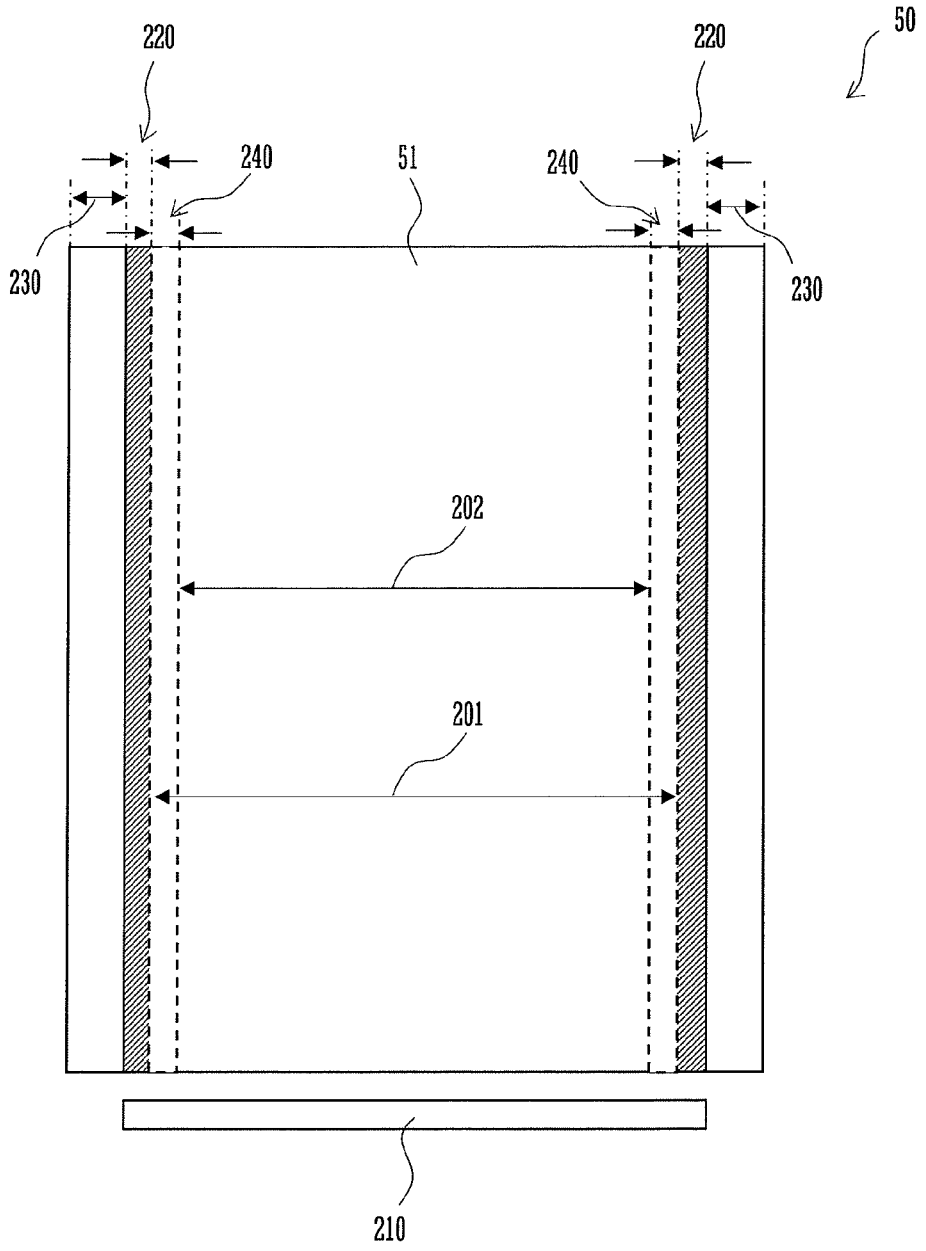
FIG. 3 is a plan view illustrating an arrangement of an intermediate transfer belt unit according to a second embodiment of the present invention.

FIG. 3 is a plan view illustrating an arrangement of the intermediate transfer belt unit 50 according to the second embodiment of the present invention.

The image forming apparatus 100 may use, in addition to a usually used recording sheet (A4 size recording sheet for example), a special recording sheet of W-size (SR-A3 size) which has a larger width than the usually used recording sheet. In this embodiment, the width of such a usually used recording sheet is determined as a usual width 202, while the width of the special recording sheet of W-size determined as the maximum width 201. A region of the intermediate transfer belt 51 which extends from an end of the usual width 202 to an end of the maximum width 201 is determined as a third region 240.

In the present embodiment, the surface of the third region 240 is made rougher than that of the widthwise central portion of the intermediate transfer belt 51.

Though the third region 240 is a region for the special recording sheet of W-size to pass therethrough, the third region 240 is less likely to be supplied with toner serving as a lubricant because the special recording sheet of W-size is not usually used.

Therefore, the present arrangement can avoid an increase in the degree of intimate contact between the cleaning blade 210 and the intermediate transfer belt 51.

The next description is directed to a third embodiment of the present invention.

Figure 4:
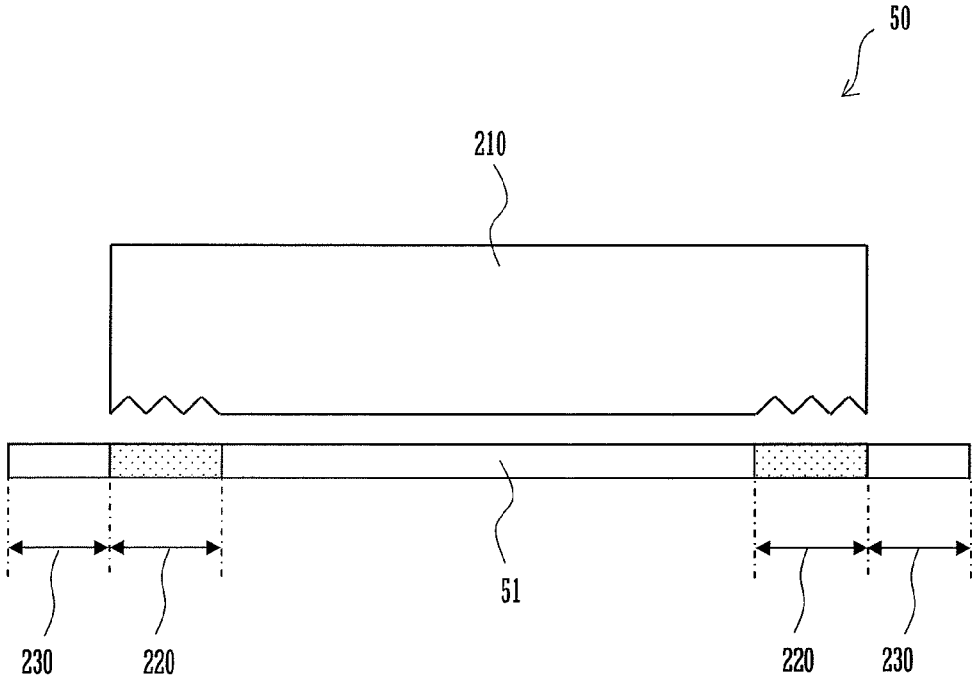
FIG. 4 is a left-hand side elevational view illustrating an arrangement of an intermediate transfer belt unit according to a third embodiment of the present invention.

FIG. 4 is a left-hand side elevational view illustrating an arrangement of the intermediate transfer belt unit 50 according to the third embodiment of the present invention.

In the present embodiment, a contact surface of the cleaning blade 210 which is in contact with the first region 220 is made rougher than that of a widthwise central portion of the cleaning blade 210.

With this arrangement in which the widthwise end portions of the cleaning blade 210 are processed to have rough surfaces, there is no need to process the intermediate transfer belt 51 and, hence, the intermediate transfer belt unit 50 can be manufactured easily.

The next description is directed to a fourth embodiment of the present invention.

Figure 5:
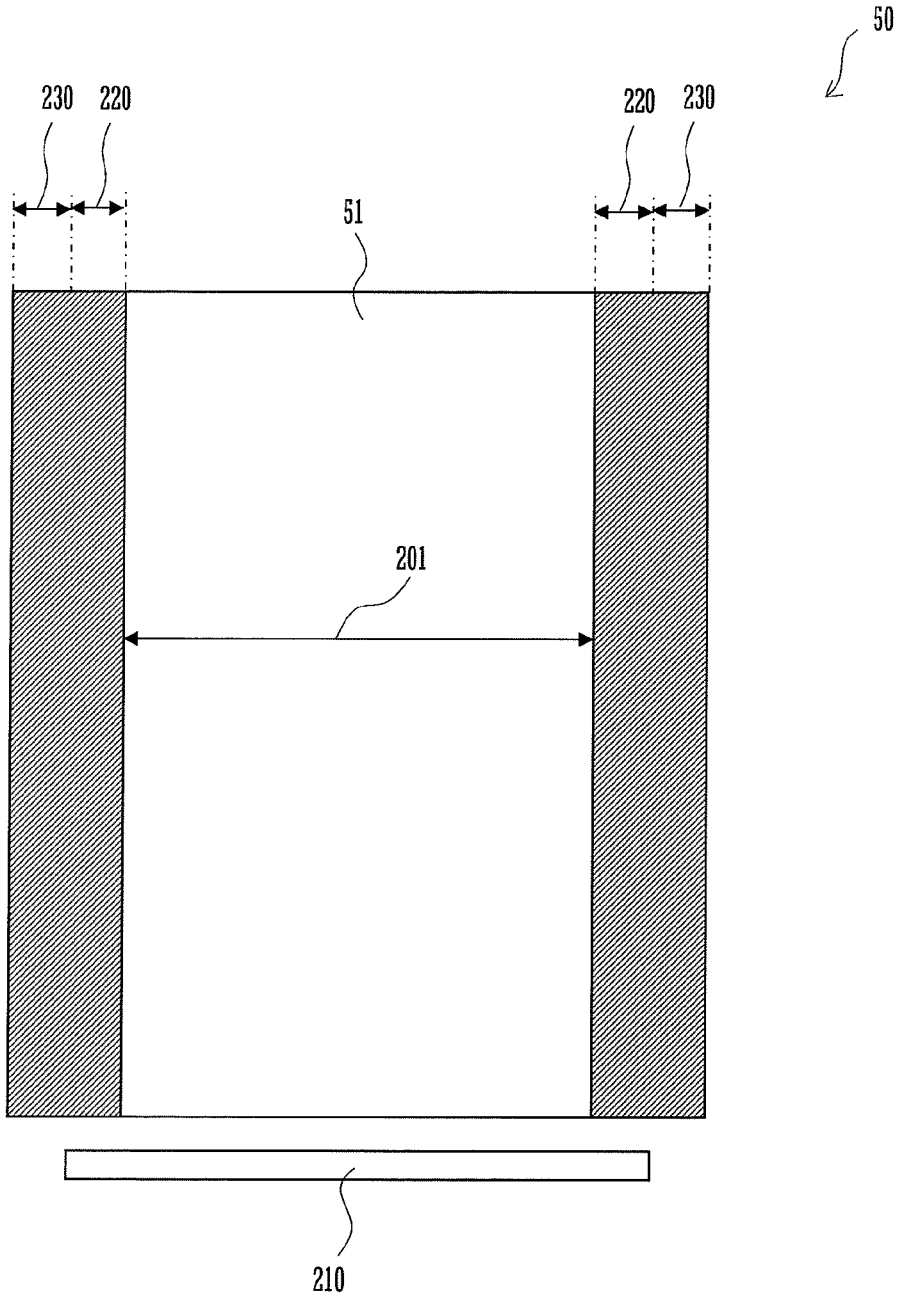
FIG. 5 is a plan view illustrating an arrangement of an intermediate transfer belt unit according to a fourth embodiment of the present invention.

FIG. 5 is a plan view illustrating an arrangement of the intermediate transfer belt unit 50 according to the fourth embodiment of the present invention.

In the present embodiment, the second region 230 is identical in surface condition with the first region 220.

With this arrangement in which the regions located outside the region for a recording sheet of the maximum usable width to pass therethrough are all made to have rough surfaces, the intermediate transfer belt 51 can be processed easily, which makes it easy to manufacture the intermediate transfer belt unit 50.

The first to fourth embodiments described above may be combined as desired.

The foregoing embodiments should be construed to be illustrative and not limitative of the present invention in all the points. The scope of the present invention is defined by the following claims, not by the foregoing embodiments. Further, the scope of the present invention is intended to include the scopes of the claims and all possible changes and modifications within the senses and scopes of equivalents.

What is claimed is:

1. A belt conveyor member comprising:

an endless belt; and a cleaning blade configured to remove residual toner remaining on a surface of the endless belt which is processed into a smooth surface, wherein the endless belt has a first region in contact with the cleaning blade which is located outside a region for a recording sheet of a maximum usable width to pass therethrough, and a second region located outside the first region, a contact surface between the cleaning blade and the first region being in a rough condition, the roughness of the contact surface being larger than the roughness of a contact surface between the cleaning blade and the region for the recording sheet of the maximum usable width to pass therethrough, the endless belt has a third region in contact with the cleaning blade, the third region located between a region for a recording sheet of normal width to pass therethrough and the region for a recording sheet of the maximum usable width to pass therethrough, a contact surface of the third region is made rougher than a widthwise central portion of the endless belt that is in contact with the region for a recording sheet of normal width to pass therethrough.

2. The belt conveyor member according to claim 1, wherein the first region is made to have a rougher surface than a widthwise central portion of the endless belt.

3. The belt conveyor member according to claim 1, wherein the cleaning blade has a contact surface in contact with the first region which is made rougher than a surface of a widthwise central portion of the cleaning blade.

4. The belt conveyor member according to claim 1, wherein the second region is identical in surface condition with the first region.

5. An image forming apparatus comprising:

the belt conveyor member according to claim 1; and a transfer device configured to transfer a toner image formed on the belt conveyor member onto a recording sheet.

* * * * *